US008804972B2

(12) United States Patent
Klein et al.

(10) Patent No.: US 8,804,972 B2
(45) Date of Patent: Aug. 12, 2014

(54) EARPLUG SEALING TEST

(75) Inventors: Nir Klein, Rishpon (IL); Yaakov Butbul, Netanya (IL)

(73) Assignee: Source of Sound Ltd, Netanya (IL)

( * ) Notice: Subject to any disclaimer, the term of this patent is extended or adjusted under 35 U.S.C. 154(b) by 1447 days.

(21) Appl. No.: 12/268,669

(22) Filed: Nov. 11, 2008

(65) Prior Publication Data

US 2009/0122996 A1 May 14, 2009

Related U.S. Application Data

(60) Provisional application No. 60/987,068, filed on Nov. 11, 2007.

(51) Int. Cl.
*H04R 29/00* (2006.01)
*H04R 1/10* (2006.01)

(52) U.S. Cl.
CPC ..... *H04R 29/00* (2013.01); *H04R 1/1016* (2013.01); *H04R 2460/15* (2013.01)
USPC ..... 381/56; 381/58; 381/60; 381/72

(58) Field of Classification Search
CPC .... H04R 29/00; H04R 29/001; H04R 1/1016; H04R 1/1019; H04R 2460/15
USPC ..... 381/56, 60, 72
See application file for complete search history.

(56) References Cited

U.S. PATENT DOCUMENTS

| | | | | |
|---|---|---|---|---|
| 4,809,708 | A * | 3/1989 | Geisler et al. | 600/559 |
| 5,317,273 | A * | 5/1994 | Hanson et al. | 324/616 |
| 5,333,622 | A * | 8/1994 | Casali et al. | 128/864 |
| 5,577,511 | A * | 11/1996 | Killion | 600/559 |
| 5,631,965 | A * | 5/1997 | Chang et al. | 381/72 |
| 5,682,020 | A * | 10/1997 | Oliveira | 181/130 |
| 5,692,059 | A * | 11/1997 | Kruger | 381/151 |
| 7,406,179 | B2 | 7/2008 | Ryan | |
| 2005/0123146 | A1 * | 6/2005 | Voix et al. | 381/60 |
| 2006/0188105 | A1 * | 8/2006 | Baskerville et al. | 381/60 |
| 2007/0147635 | A1 * | 6/2007 | Dijkstra et al. | 381/94.1 |
| 2007/0160243 | A1 * | 7/2007 | Dijkstra et al. | 381/317 |
| 2008/0144840 | A1 * | 6/2008 | Goldstein et al. | 381/56 |

OTHER PUBLICATIONS

Knowles Acoustics, FG Series Microphones.

* cited by examiner

*Primary Examiner* — Minh-Loan T Tran
*Assistant Examiner* — Fazli Erdem

(57) ABSTRACT

Methods and system for a sealing test comprising the steps of: sealing a predefined volume of gas; sampling a predefined frequency range, whereby there is no need to inject a predefined sound wave while sampling the predefined frequency range; and determining whether the predefined volume of gas is sealed or unsealed according to the sampled frequency range.

12 Claims, 6 Drawing Sheets

EARPLUG SEALING TEST

CROSS-REFERENCE TO RELATED APPLICATIONS

This application claims the benefit of U.S. Provisional Patent Application No. 60/987,068, filed Nov. 11, 2007, which is hereby incorporated by reference in its entirety for all that it teaches without exclusion of any part thereof.

FIELD OF THE INVENTION

The embodiments of the present invention relate to an electronic earplug and, more particularly, to methods and devices for testing whether an electronic earplug is sealed.

BACKGROUND

Complete theoretical descriptions, details, explanations, examples, and applications of the subjects and phenomena related to acoustic waveguides, microphones and electronic earplugs are readily available in standard references in the fields of acoustics, mechanical engineering, and electrical engineering.

BRIEF DESCRIPTION OF THE DRAWINGS

The embodiments of the present invention are herein described, by way of example only, with reference to the accompanying drawings. With specific reference now to the drawings, it is stressed that the particulars shown are by way of example and for purposes of illustrative discussion of the embodiments of the present invention only, and are presented in order to provide what is believed to be the most useful and readily understood description of the principles and conceptual aspects of the embodiments of the present invention. In this regard, no attempt is made to show structural details of the embodiments in more detail than is necessary for a fundamental understanding of the invention. In the drawings.

DETAILED DESCRIPTION

Figure 1A:
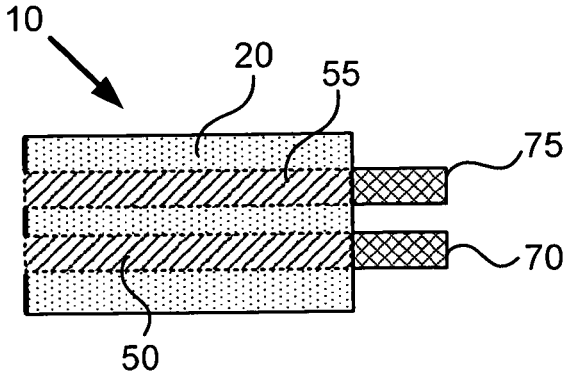
FIGS. 1A to 4 are schematic illustrations of earplugs, in accordance with the present invention.

In the following description, numerous specific details are set forth. However, the embodiments of the invention may be practiced without some of these specific details. In other instances, well-known hardware, software, materials, structures and techniques have not been shown in detail in order not to obscure the understanding of this description. In this description, references to "one embodiment" or "an embodiment" mean that the feature being referred to may be included in at least one embodiment of the invention. Moreover, separate references to "one embodiment" in this description do not necessarily refer to the same embodiment. Illustrated embodiments are not mutually exclusive, unless so stated and except as will be readily apparent to those of ordinary skill in the art. Thus, the invention may include any variety of combinations and/or integrations of the embodiments described herein. Also herein, flow diagrams illustrate non-limiting embodiment examples of the methods, and block diagrams illustrate non-limiting embodiment examples of the devices. Some operations in the flow diagrams may be described with reference to the embodiments illustrated by the block diagrams. However, the methods of the flow diagrams could be performed by embodiments of the invention other than those discussed with reference to the block diagrams, and embodiments discussed with reference to the block diagrams could perform operations different from those discussed with reference to the flow diagrams. Moreover, although the flow diagrams may depict serial operations, certain embodiments could perform certain operations in parallel and/or in different orders from those depicted. Moreover, the use of repeated reference numerals and/or letters in the text and/or drawings is for the purpose of simplicity and clarity and does not in itself dictate a relationship between the various embodiments and/or configurations discussed. Furthermore, methods and mechanisms of the embodiments will sometimes be described in singular form for clarity. However, it should be noted that some embodiments may include multiple iterations of a method or multiple instantiations of a mechanism unless noted otherwise. For example, when a controller or an interface are disclosed in an embodiment, the scope of the embodiment is intended to also cover the use of multiple controllers or interfaces.

FIG. 1A is a cross section illustration of one embodiment of an electronic earplug. The earplug 10 includes the following elements: an acoustic conduction tube 50 for conducting sound waves from the ear canal to a microphone 70, an acoustic conduction tube 55 for conducting sound waves from a speaker 75 to the ear canal, and sealing material 20, such as foam, silicon or any other material capable of supplying passive attenuation of outside noise.

In one embodiment, the electronic earplug is coupled to an electronic unit for analyzing the sound waves measured by the microphone.

Optionally, the sealing test is performed before the earplug user enters a noisy zone and/or while the user is in the noisy zone, in order to verify that the user's ear is protected.

In one embodiment, the acoustic conduction tubes 50 and 55 are close to one another. For the sake of simplicity, FIGS. 2, 3 and 4 illustrate only the acoustic conduction tube 50 and the microphone 70, but it is to be understood that the earplug 10 may also include a speaker (not shown in the figures).

Figure 1B:
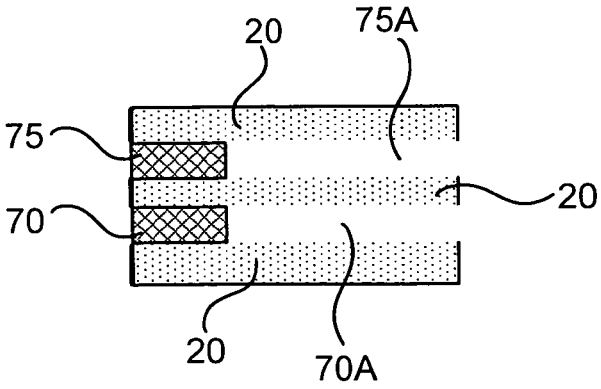

FIG. 1B is a cross section illustration of one embodiment of an electronic earplug. The earplug 10 includes the following elements: a microphone 70, optionally directed towards the eardrum; a speaker 75, optionally directed towards the eardrum; sealing material 20; and optional spaces 70A and 75A for operating the microphone and the speaker respectively. Alternatively, the microphone and/or the speaker may extend up to the end of the sealing material such that there is no need for the optional spaces 70A and 75A.

Figure 2:
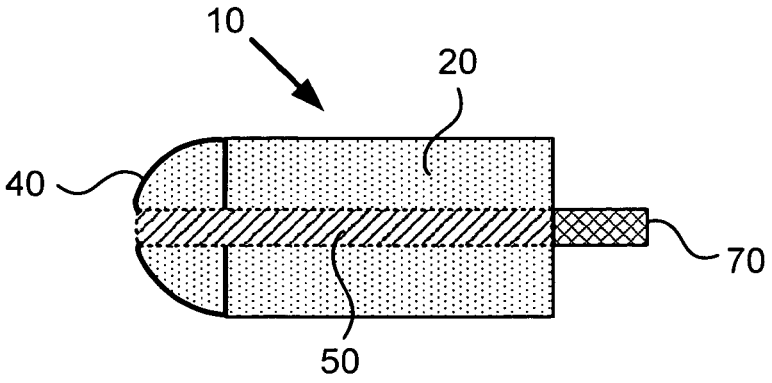
Figure 3:
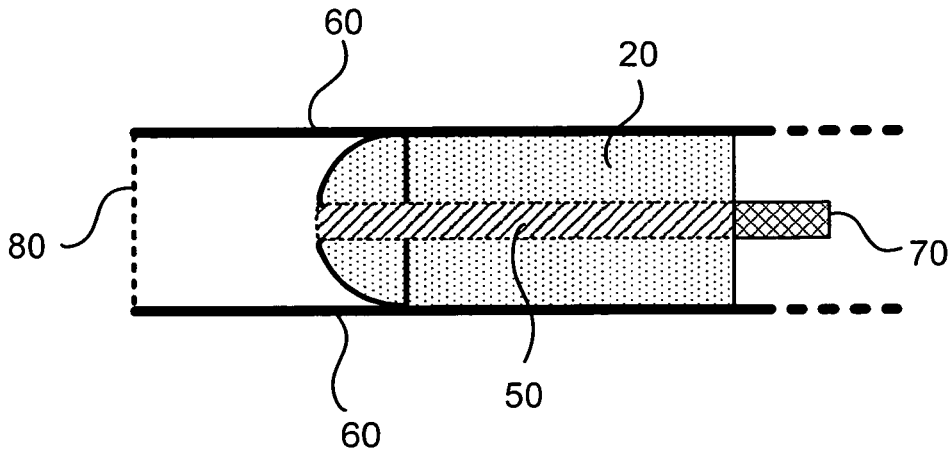
Figure 4:
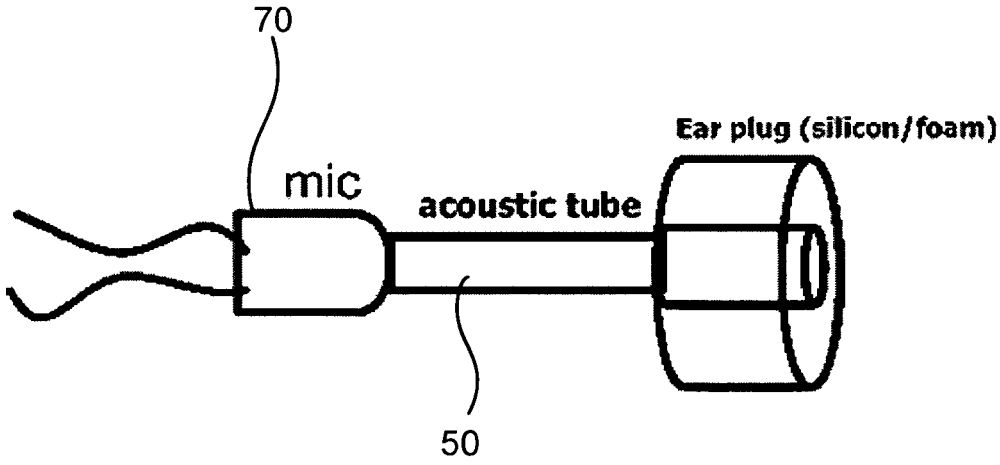

Referring to FIGS. 2 and 3, in one embodiment of the invention, the earplug 10 has an external diameter smaller than the ear canal 60 and includes an acoustic conduction tube 50, a peripheral annular sealing material 20 (optionally foam), and a flexible flanged tip 40 that exerts negligible pressure on the wall of the ear canal 60 and prevents an accidental scratching of the ear canal. One end of the earplug 10 is held in place in the ear canal by the peripheral annular sealing material 20, such as foam or silicon. The opposite end of the earplug 10 is connected to a microphone and optionally to a communication system sound source (not illustrated in the figures). Optionally, the peripheral annular sealing material 20 is peripheral annular resilient retarded-recovery foam.

FIG. 3 illustrates the above described earplug 10 within the ear canal 60. As illustrated, the peripheral annular foam 20 holds the earplug 10 in the ear canal, and the flexible flanged tip 40 exerts negligible pressure on the wall of the ear canal 60 and prevents accidental scratching of the ear canal.

FIG. 4 is another schematic illustration of one embodiment of the invention, comprising a microphone, an acoustic tube and sealing material surrounding the acoustic tube.

In one embodiment, the acoustic tube has an external diameter between 0.5 mm and 3 mm and an internal diameter between 0.3 mm and 2 mm. In one embodiment, the acoustic tube is made of an organic material, such as, but not limited to, the material used for the shrinking sleeve of "Versafit 4V" manufactured by "Raychem". In one embodiment, the microphone is somewhat similar to the FG Series Microphones manufactured by "Knowles Acoustics". Additionally or alternatively, to facilitate insertion of the earplug 10, the acoustic conduction tube 50 may be hard enough to enable a user to hold the conduction tube 50 with his or her fingers when inserting the earplug 10 into the ear canal 60.

In one embodiment, the following method is used for testing whether the electronic earplug is sealed or not.

(i) Inserting the earplug into the ear canal.

(ii) Sampling a predefined frequency range using the microphone (iii) Determining whether the earplug is sealed or unsealed according to the predefined sampled frequency range.

Figure 5:
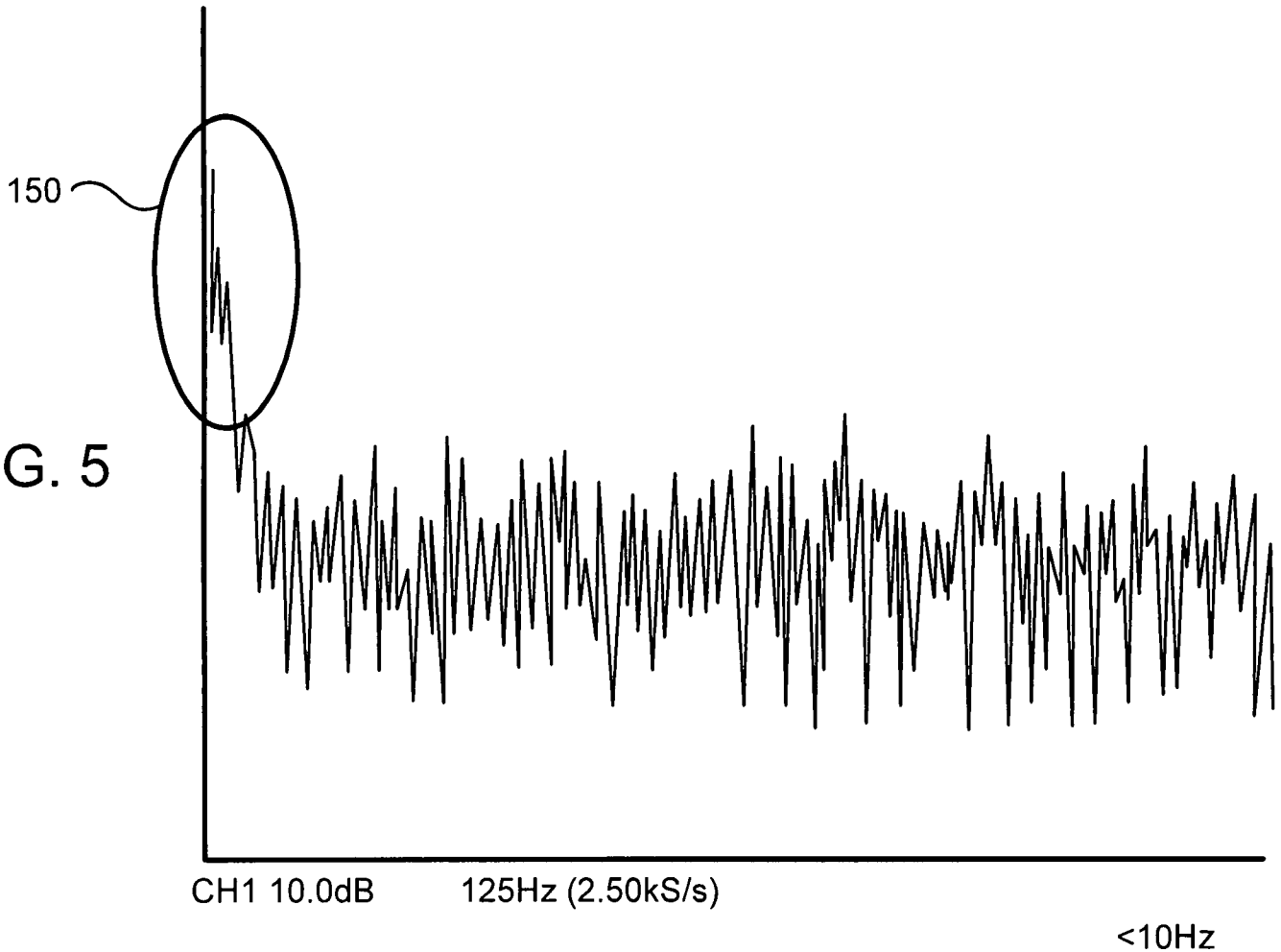
FIG. 5 is a schematic illustration of the frequency response of a sealed earplug measured by a microphone, in accordance with the present invention.
Figure 6:
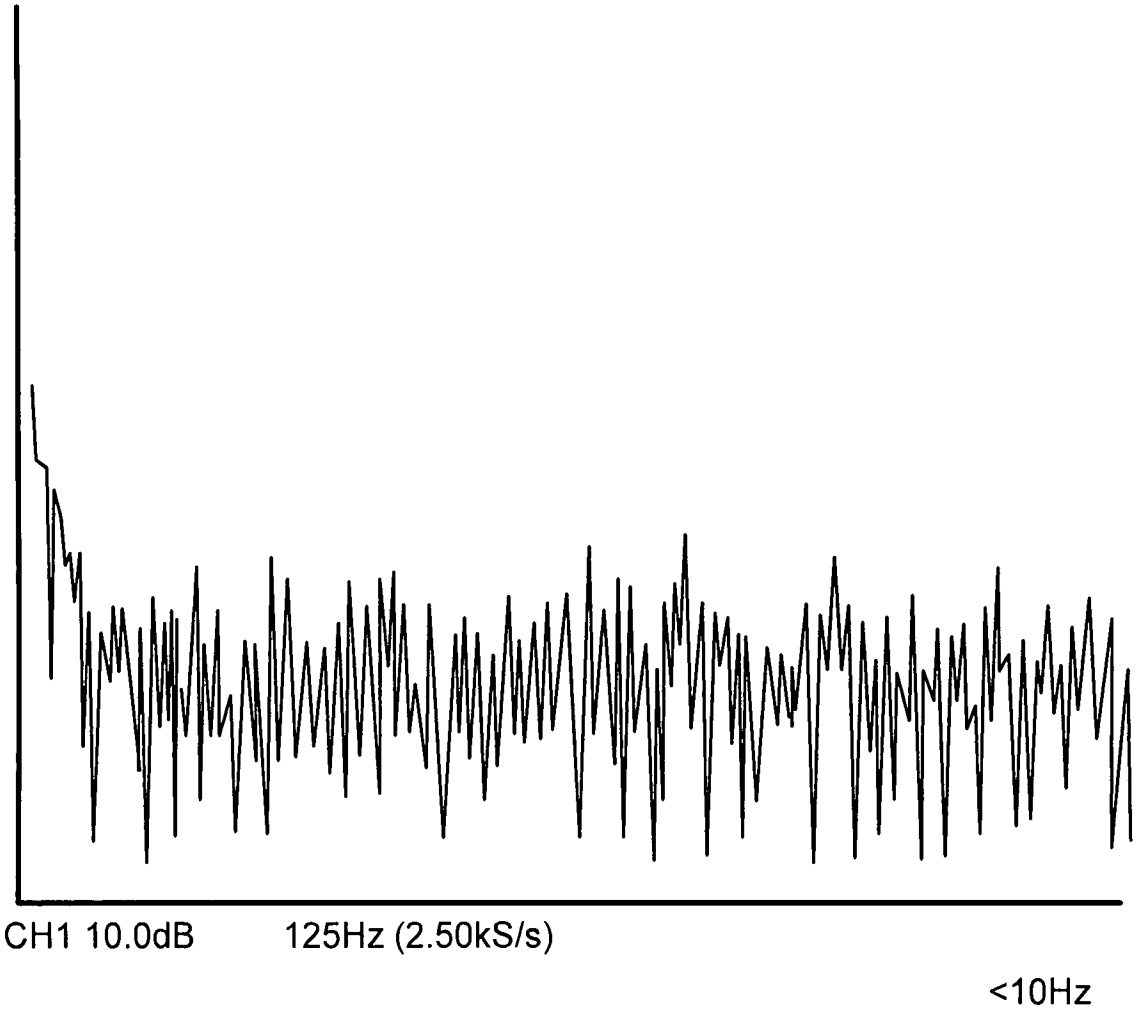
FIG. 6 is a schematic illustration of the frequency response of an unsealed earplug measured by a microphone, in accordance with the present invention.

FIG. 5 illustrates a representative frequency response of a sealed electronic earplug. FIG. 6 illustrates a representative frequency response of the same electronic earplug when it is not sealed. As clearly illustrated by the figures, the microphone of the sealed earplug and the microphone of the unsealed earplug output different frequency responses in the low frequencies region.

Figure 7:
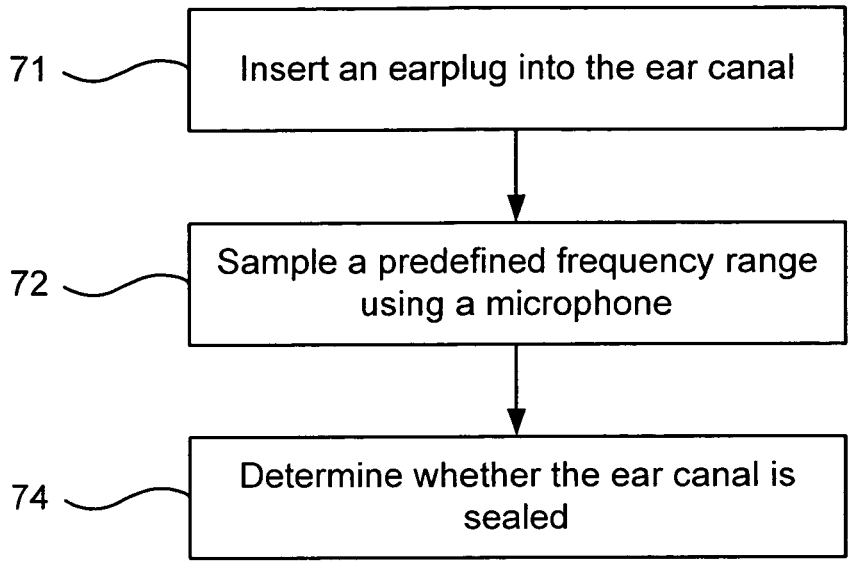
FIG. 7 is a flow diagram illustrating one method, in accordance with the present invention.

FIG. 7 is a flow diagram illustrating one method comprising the following steps: In step 71, inserting an earplug into the ear canal, wherein the earplug comprises a microphone; In step 72, sampling a predefined frequency range using the microphone; And in step 74, determining whether the ear canal is sealed or unsealed according to the sampled frequency range.

In one embodiment, a sealed earplug features a distinguishable frequency response 150 in the range of 10-20 Hz, as illustrated by FIG. 5, while the unsealed earplug does not feature the distinguishable frequency response in the range of 10-20 Hz, as illustrated in FIG. 6. It should be noted that the horizontal axis represents frequency in units of Hz, wherein each square represents 125 Hz. The unit of the vertical axis is milli Volts, optionally measured by the microphone 70. The microphone 70 is coupled to an electronic unit which analyzes the measured sound waves. In one embodiment, the electronic unit is placed near the microphone, for example, in the ear canal, in the outer ear, or behind the ear. In another embodiment, the electronic unit is placed remotely and may be coupled to the microphone using wires and/or a wireless link.

In one embodiment, the sealing test illustrated in the above embodiments is performed without injecting a specific sound wave into the ear canal, i.e. the sealing test is a passive activity performed only by using the microphone. Moreover, the sealing test illustrated above may be useful for any device featuring: (i) passive attenuation, (ii) a conch effect, and (iii) a microphone coupled to its electronics. For example, the method may also be useful for some types of earphones or earmuffs.

Figure 8:
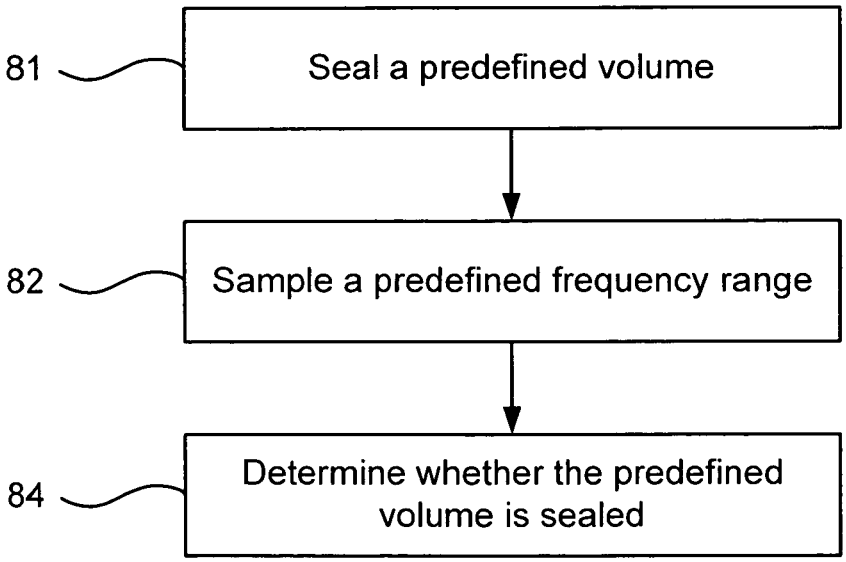
FIG. 8 is a flow diagram illustrating one method, in accordance with the present invention.

FIG. 8 is a flow diagram illustrating one method comprising the following steps: In step 81, sealing a predefined volume of air; In step 82, sampling a predefined frequency range using a microphone; Optionally, there is no need to inject a predefined sound wave while sampling the predefined frequency range; And in step 84, determining whether the predefined volume is sealed or unsealed according to the sampled frequency range.

It is to be understood that the embodiments are not limited in their applications to the details of operation or implementation of the devices and methods set forth in the description, drawings, or examples.

While the embodiments have been described in conjunction with specific examples thereof, it is to be understood that they have been presented by way of example, and not limitation. Moreover, it is evident that many alternatives, modifications and variations will be apparent to those skilled in the art. Accordingly, it is intended to embrace all such alternatives, modifications and variations that fall within the spirit and scope of the appended claims and their equivalents.

What is claimed is:

1. An electronic earplug comprising:

a microphone, coupled to a sound tube directed towards the eardrum, such that the microphone measures interior sounds existing in the ear canal, a sealing element, and means for performing automatic sealing test without injecting a predefined sound wave into the ear canal for performing the automatic sealing test.

2. The electronic earplug of claim 1, wherein frequency response sampled by the microphone in the low frequencies region is different for a sealed and unsealed ear canal.

3. The electronic earplug of claim 1, wherein a sealed earplug features a distinguishable frequency response approximately in the region of 5-30 Hz.

4. A device comprising:

a microphone, coupled to a sound tube directed towards the eardrum, such that the microphone measures interior sounds existing in the ear canal, a sealing element, a storage element operative to store data characterizing a frequency response of a sealed volume of gas, and a processing unit operative to analyze samples received from the microphone and to determine, without injecting a specific sound wave into the volume of gas, whether the volume of gas in which the microphone is operating in is sealed.

5. The device of claim 4, wherein the device is an electronic earplug.

6. The device of claim 5, wherein the gas is air and the sealed volume of air is in the ear canal.

7. The device of claim 5, wherein a sealed electronic earplug features a distinguishable frequency response in the region of 5-30 Hz.

8. The device of claim 4, wherein the gas is air, the sealed volume of air is in the ear canal, and the frequency response sampled by the microphone in the low frequencies region is different for a sealed and unsealed ear canal.

9. The device of claim 4, wherein the device does not comprise a speaker.

10. The device of claim 4, wherein the device further comprises a speaker, and the processing unit does not operate the speaker while analyzing the samples received from the microphone for determine whether the volume of gas in which the microphone is operating in is sealed.

11. The device of claim 4, wherein the device is a sealing device.

12. The device of claim 11, further comprising a speaker, and wherein the device is an earphone or a headphone.

* * * * *